United States Patent [19]

Fleming

[11] 4,301,776

[45] Nov. 24, 1981

[54] CRANKSHAFT APPARATUS

[76] Inventor: Joseph W. Fleming, 8381 Post Rd., Allison Park, Pa. 15101

[21] Appl. No.: 125,407

[22] Filed: Feb. 28, 1980

Related U.S. Application Data

[63] Continuation-in-part of Ser. No. 45,021, Jun. 4, 1979, abandoned.

[51] Int. Cl.[3] ..... F02B 75/32

[52] U.S. Cl. ..... 123/197 AC; 123/197 R

[58] Field of Search ..... 123/197 R, 197 AC

[56] References Cited

U.S. PATENT DOCUMENTS

| | | | |
|---|---|---|---|
| 317,015 | 5/1885 | Reis | 123/50 R |
| 1,505,856 | 8/1924 | Briggs | 123/197 AC |
| 1,806,608 | 5/1931 | Bryant | 123/197 AC |
| 1,873,908 | 8/1932 | Schinke | 123/197 AC |
| 3,025,840 | 3/1962 | Casini | 123/197 AC |

*Primary Examiner*—Ronald B. Cox

*Attorney, Agent, or Firm*—Thomas H. Murray; Clifford A. Poff

[57] ABSTRACT

An equal diameter cam is mounted on the output shaft of an internal combustion engine or drive shaft of a piston-type compressor. A piston is joined by a connecting rod to a frame carrying two equal diameter follower rollers engaging the surface of a cam and located at diametrically-opposite points on a line through the center of rotation of the cam. A control arm can be used to control the position of a follower roller. The rotational axis of each follower roller is spaced by the cam surface from the rotational axis of the drive output shaft to transmit torque by converting reciprocating motion impressed by the follower rollers on the cam surface according to the equation:

$$R=r+\tfrac{1}{2}S\sin(\theta)+\tfrac{1}{2}S'\sin 3(\theta+a)+\tfrac{1}{2}S''\sin 5(\theta+b)+\tfrac{1}{2}S'''\sin 9(\theta+c)+\tfrac{1}{2}S''''\sin 15(\theta+d)+\tfrac{1}{2}S'''''\sin 45(\theta+e)$$

where:

R is the radial distance between the rotational axes of the shaft member and a follower member at angle $\theta$, r is the average displacement radius of the axis of the follower roller, S, S', S'', S''', S''''S and ''''' are radial variations in the cam surface with S not equal to zero and having the greatest absolute value, a, b, c, d and e are fixed phase angles with any value of ± from 0° to 180°, and $\theta$ is the angular displacement of a reference mark on the cam to the center line of reciprocating motion of the follower rollers.

The S-prime factors in this equation define harmonics that may be developed on the surface of the cam.

7 Claims, 11 Drawing Figures

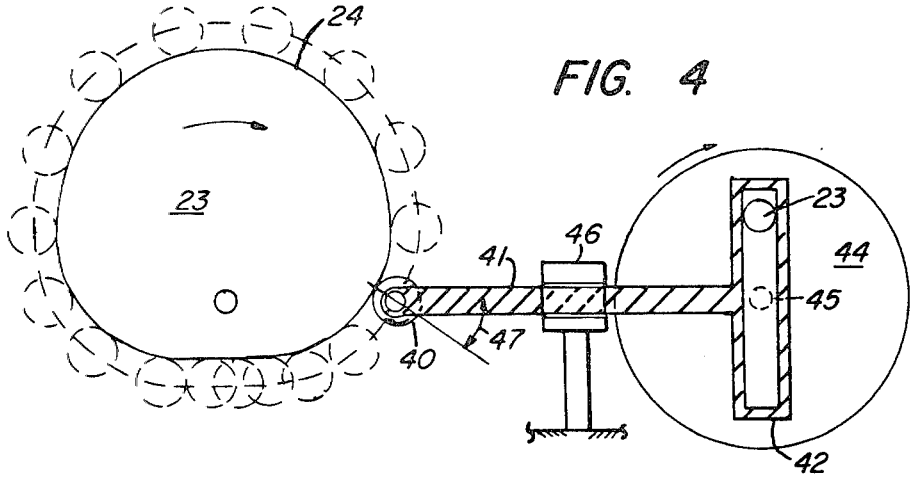
FIG. 4
FIG. 5
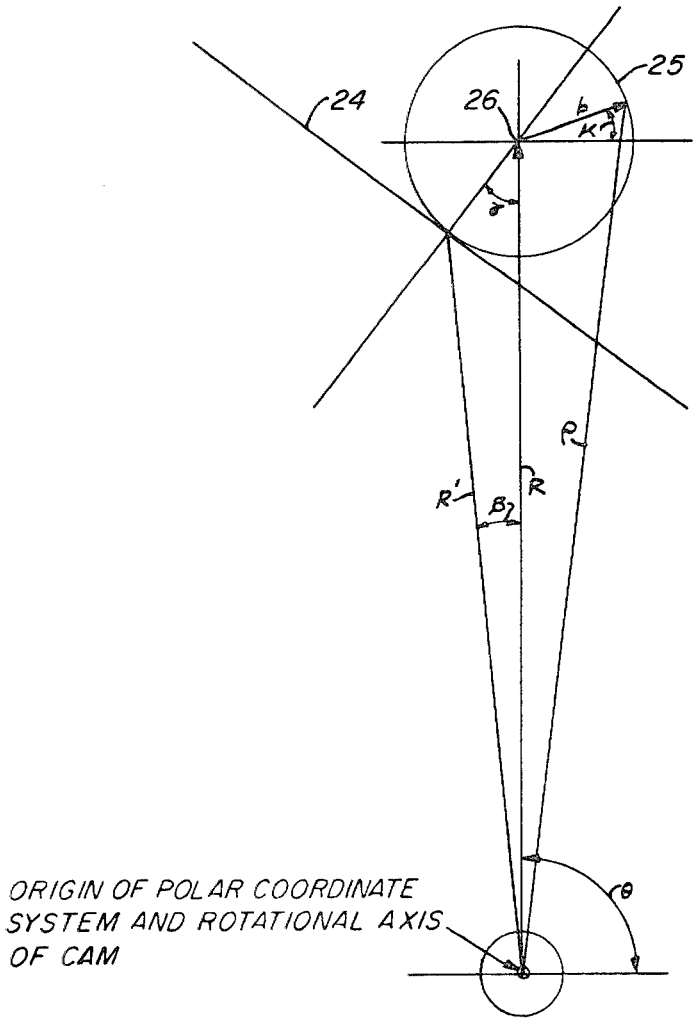

CRANKSHAFT APPARATUS

CROSS-REFERENCE TO RELATED APPLICATION

This application is a continuation-in-part of application Ser. No. 45,021, filed June 4, 1979, now abandoned.

BACKGROUND OF THE INVENTION

This invention relates to an improved crankshaft apparatus to form a mechanical couple between a drive shaft and a piston arranged to reciprocate within a cylinder for an improved relationship of moving parts as compared with a conventional lobe-type crankshaft. The crankshaft apparatus of the invention is particularly advantageous for an internal combustion engine or compressor wherein a fluid medium is compressed incident to the operation thereof by employing a constant diameter cam having a cam surface in contact with two equal diameter follower rollers at generally diametrically-opposite points. More specifically, the present invention is directed to the development of a particular cam surface including, if desired, harmonics of the developed surface and/or additional motion control members for producing a greater torque in the drive output shaft of an internal combustion engine.

The power delivered from an internal combustion engine is directly proportional to the torque applied to the output shaft and the rotary speed. Gasoline, gas or diesel engines designed for a two-cycle or four-cycle operation use a crankshaft and a connecting rod in a mechanical system to change the reciprocating motion of the piston to rotary motion of the output shaft. The throw of the crank requires the connecting rod to assume various angles to the direction of movement of the piston whereby the transmission of torque per unit of force between the crankshaft and the piston is not always efficient. At the time of maximum torque per unit of force by expansion of gases on the piston, i.e., about 80° of rotation after top dead center, the lobe of the crank moves to a large non-aligned relation with movement of the piston. Torque from the crank is resolved into a force on the piston in another part of the operating cycle of an internal combustion engine; and in a similar way, in a piston-type air compressor. In this instance, an undesirably large torque per unit of force is required because of the angular relation between the lobe of the crank and the piston. This invention is addressed to an improved crankshaft apparatus having preferred forms to produce substantially greater torque during the power stroke in an internal combustion engine as compared with a conventional crankshaft apparatus. The invention further provides an improved crankshaft apparatus which is designed to take greater advantage of the pressure curve developed in an internal combustion engine during the power stroke. The improved crankshaft apparatus reduces the required torque per unit of force during the compression stroke by an engine as well as by a piston-type compressor.

SUMMARY OF THE INVENTION

It is an object of the present invention to provide a crankshaft apparatus for an internal combustion engine or a piston-type compressor wherein reciprocation of the piston moves two equal diameter follower rollers along a constant diameter cam surface formed by a cam plate on a shaft member to transmit force to a piston for compressing gases in a cylinder and to produce a torque output of an engine.

It is a further object of the present invention to provide a crankshaft apparatus for an internal combustion engine embodying a construction and arrangement of parts to produce greater torque per unit of force imposed on the piston of an internal combustion engine as compared with a conventional constant-throw crankshaft arrangement.

More particularly, according to the present invention, there is provided a crankshaft apparatus in an internal combustion engine or a compressor having a piston arranged to reciprocate within a cylinder to act on a fluid medium within a chamber at one end of the piston, the crankshaft apparatus includes the combination of a shaft member carried by bearing supports for rotation about an axis perpendicular to reciprocation of the piston in the cylinder at the end thereof opposite the chamber, a cam plate defining a cam surface and secured to the shaft member for rotation thereof, two equal diameter diametrically-opposite follower rollers engaging the cam surface to rotate relative to the cam, and carrier means supporting the follower rollers which rotate about axes generally parallel with the rotational axis of the shaft member, the carrier means interconnecting the follower rollers with the piston, the rotational axis of any selected follower roller being spaced by the cam surface from the rotational axis of the shaft member according to the polar equation:

$$R=r+\tfrac{1}{2}S\sin(\theta)+\tfrac{1}{2}S'\sin 3(\theta+a)+\tfrac{1}{2}S''\sin 5(\theta+b)+\tfrac{1}{2}S'''\sin 9(\theta+c)+\tfrac{1}{2}S''''\sin 15(\theta+d)+\tfrac{1}{2}S'''''\sin 45(\theta+e)$$

where:

- R is the radial distance between the rotational axes of the shaft member and a follower member at angle $\theta$,
- r is the average displacement radius of the axis of the follower roller,
- S, S′, S″, S‴, S⁗ and S′′′′′ are radial variations in the cam surface with S not equal to zero and having the greatest absolute value,
- a, b, c, d and e are fixed phase angles with any value of ± from 0° to 180°, and
- $\theta$ is the angular displacement of the cam from the center line between the shaft member and follower member.

In one embodiment of the crankshaft apparatus according to the present invention, the aforesaid carrier means includes a carrier housing extending along each side of the cam plate with each housing having a slide plate rotatably supported on the shaft member and guide rods movably supported by the slide plate to maintain a constant distance between the follower rollers. In the preferred form of the present invention, the follower diameter is defined to equal the diameter of the milling cutter passed about the cam plate for defining the cam surface. In the above polar equation, when S′, S″, S‴, S⁗ and S′′′′′ are not all equal to zero, the cam surface includes impressed harmonics at selected sites for improving the motion conversion characteristics of the crankshaft apparatus.

In another embodiment of the crankshaft apparatus according to the present invention, at least one, but preferably two, control arms guide and absorb side thrust on the follower rollers. It is preferred to suport each control arm for pivotal movement at one end while joined at its other end to the carrier means and/or follower roller to thereby eliminate the need for a rigid structure between the piston and the follower roller. The follower roller moves along an arcuate path defined by the pivotal movement of the control arm relative to a line between the shaft member and the central axis of the piston. When a control arm extends in a direction generally between the cam and the piston, a guide plate is used to maintain correct alignment of the to and bottom follower rollers. However, such a guide plate can be eliminated when a second control arm is oppositely arranged to the first control arm at the opposite side of the cam. Moreover, when two diametrically-opposite control arms are used, the connecting rods extending between the follower rollers are subject to tension and compression only and are free of flexing as might otherwise occur.

The use of the aforementioned control arms offers significant advantages, particularly in regard to the fact that the torque per unit of force on the piston is no longer symmetrical or equal during the down and up strokes by the piston.

These features and advantages of the present invention as well as others will be more fully understood when the following description of various embodiments of the invention is read in light of the accompanying drawings, in which:

FIG. 4 is a schematic illustration of apparatus to produce a cam for use in the crankshaft apparatus of the present invention;

FIG. 5 is a polar coordinate diagram illustrating the development of the cam follower system;

Figure 6:
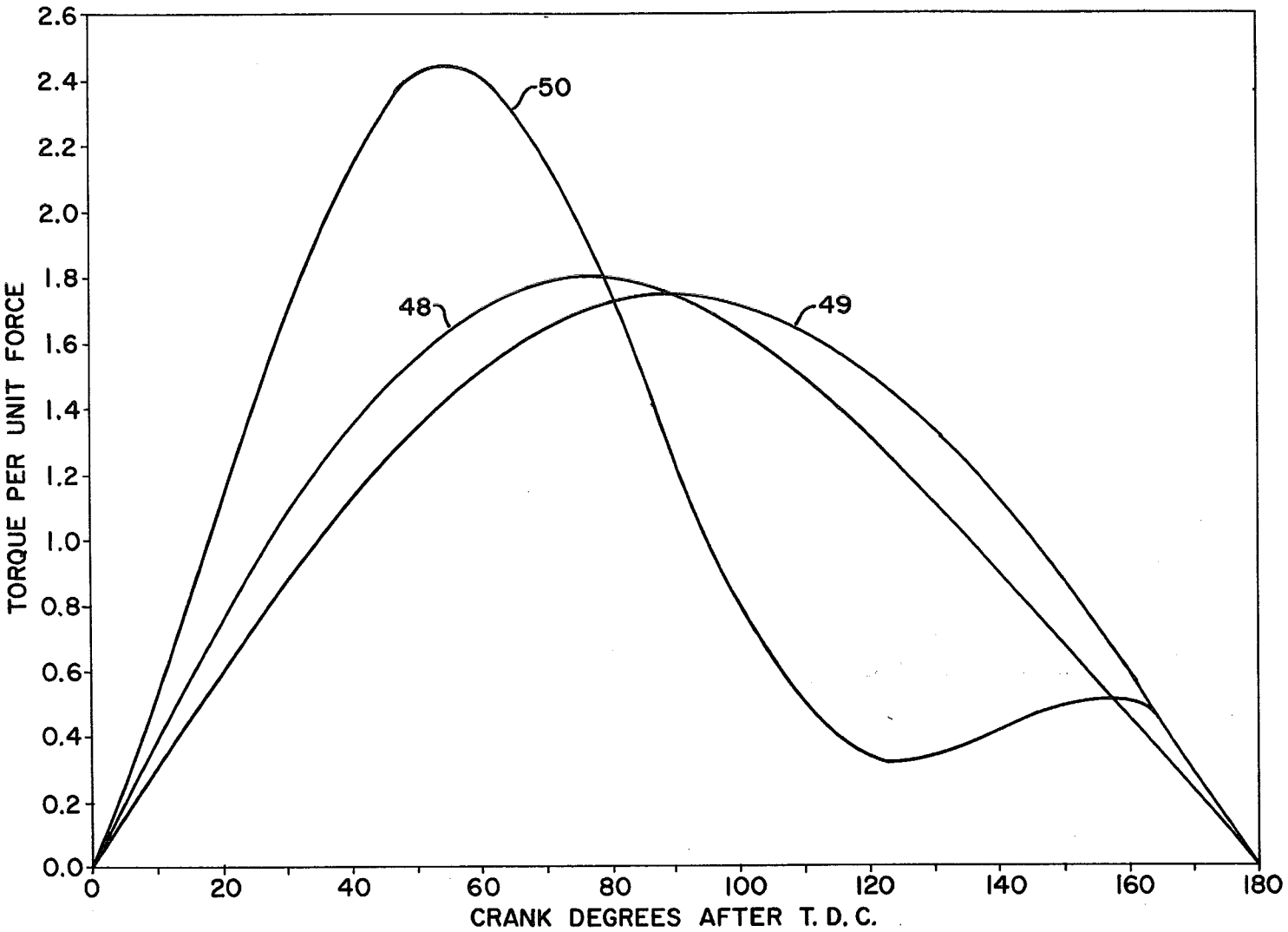
FIG. 6 is a graph illustrating, by comparison, torque per unit of force versus crank angle degrees after top dead center of a conventional crankshaft and two crankshafts according to the present invention.
Figure 7:
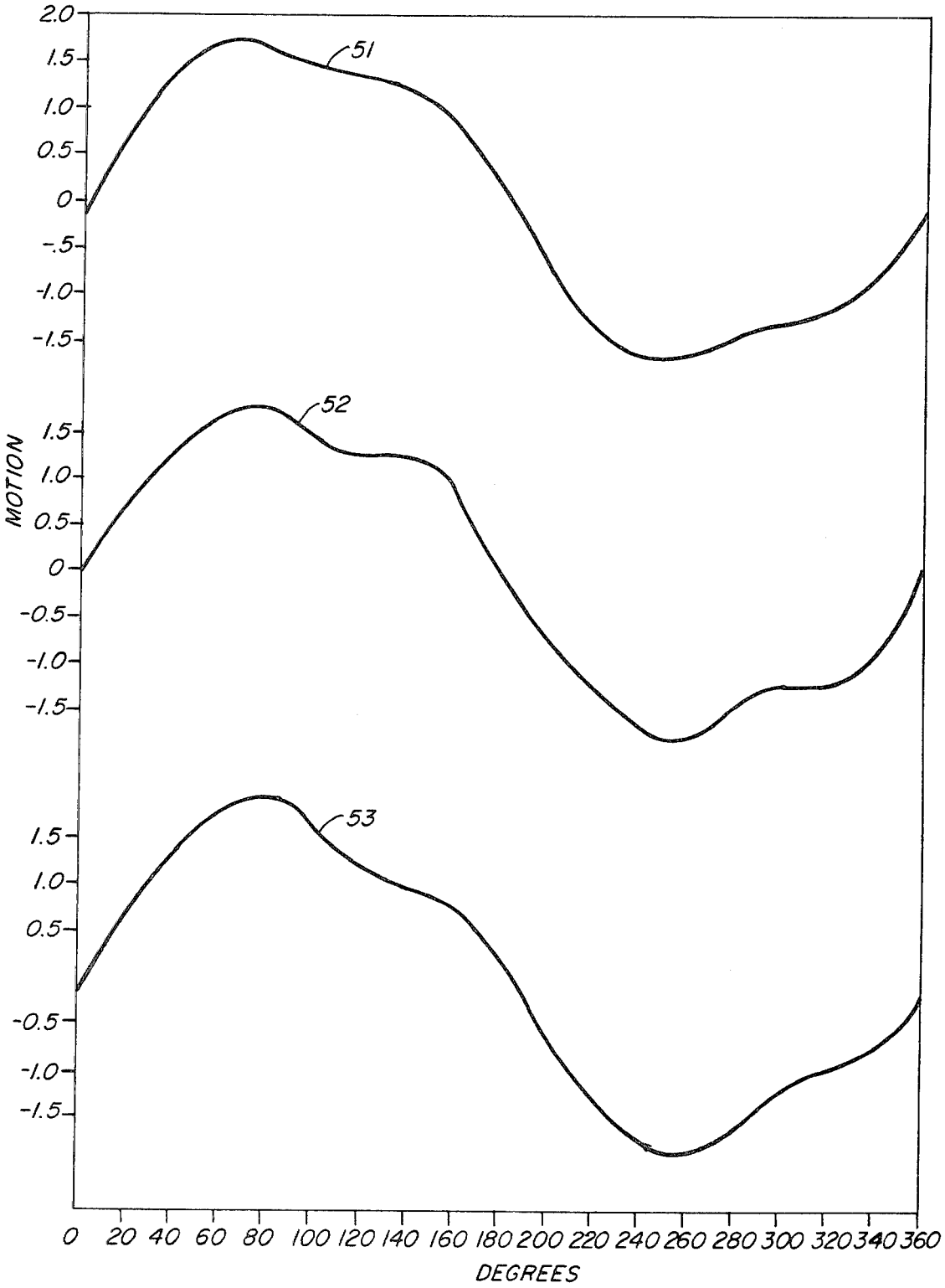
FIG. 7 is a series of curves illustrating displacement of followers versus rotation of cams embodying a sinusoidal cam surface with harmonics.
Figure 9:
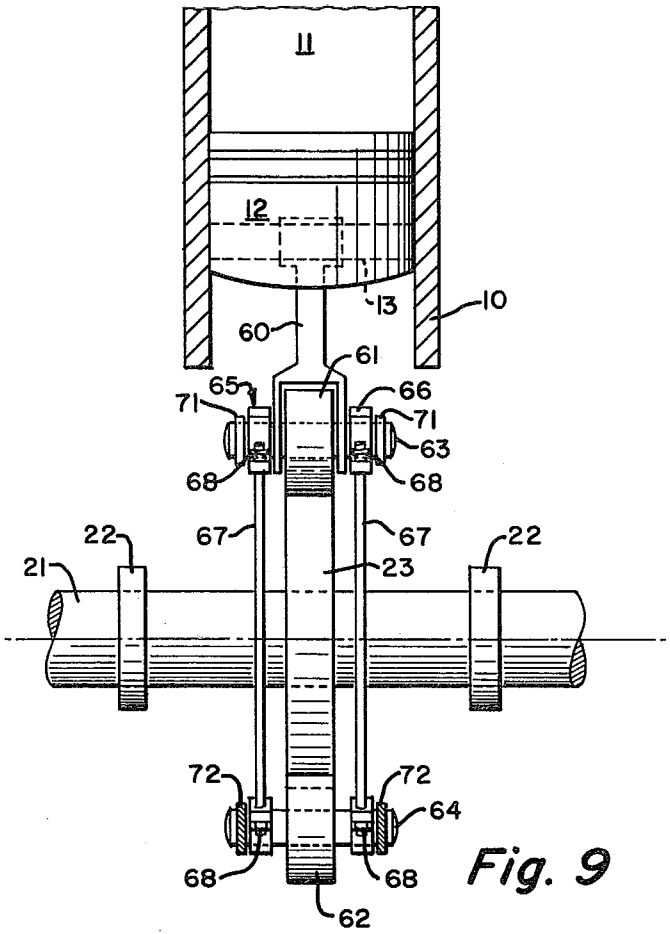
FIG. 9 is a sectional view taken along line IX—IX of FIG. 8.
Figure 8:
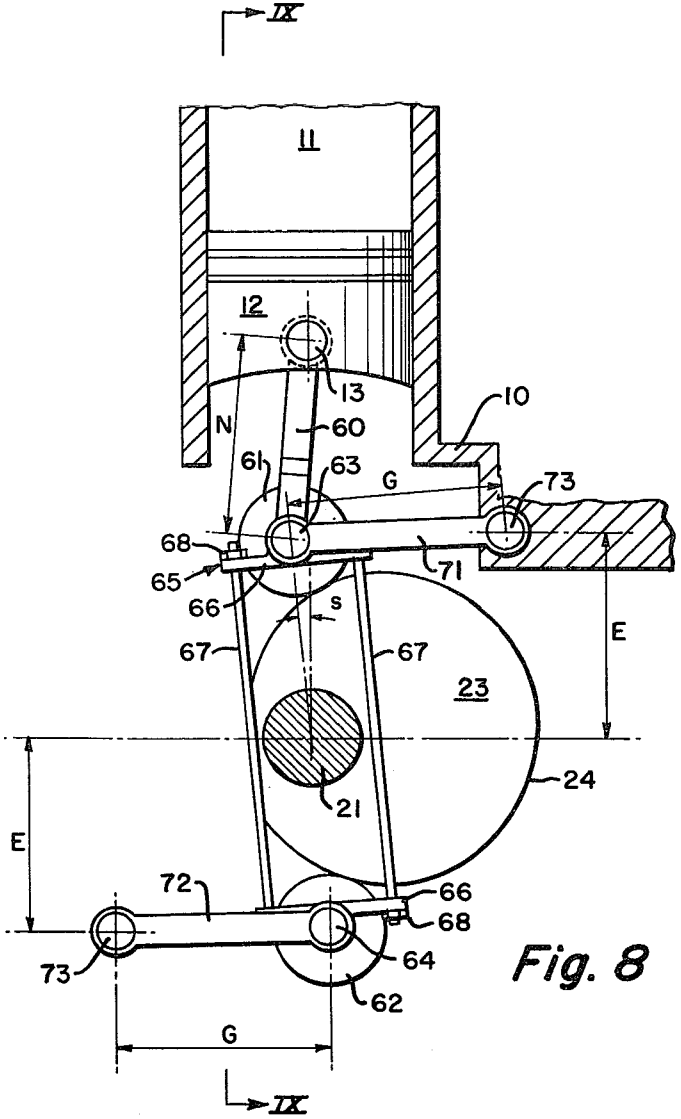
FIG. 8 is a partial elevational view, similar to FIG. 1, but illustrating a further embodiment of the present invention.
Figure 10:
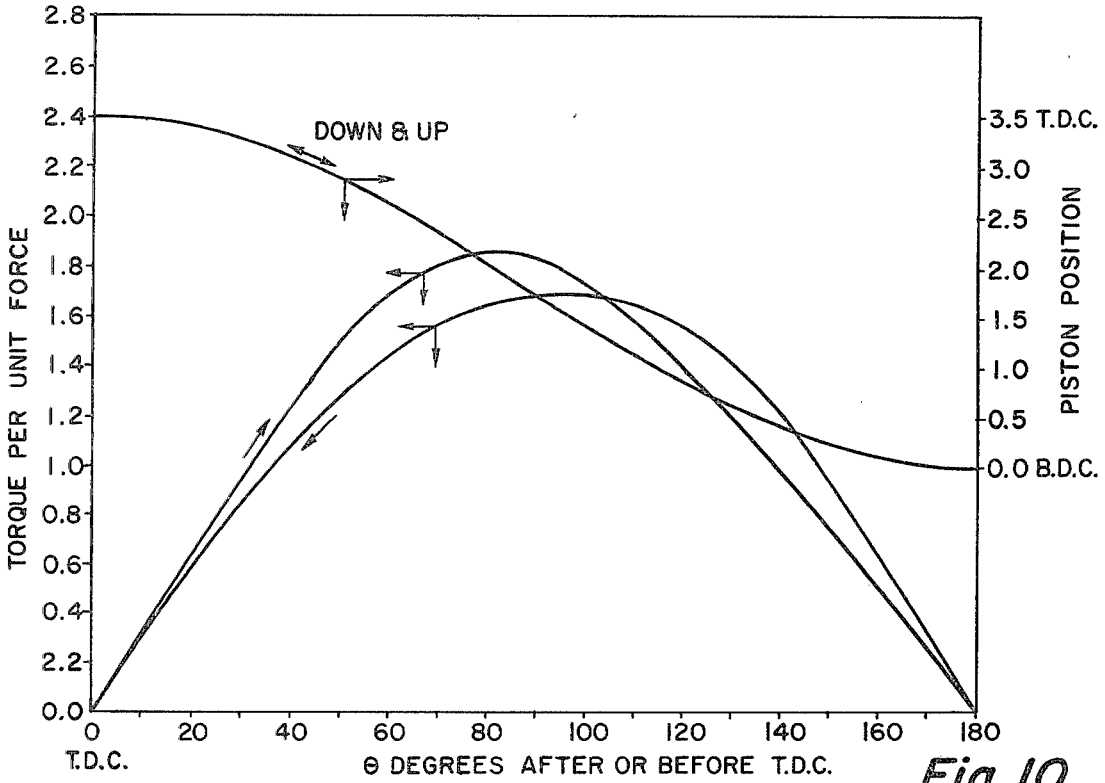
Figure 11:
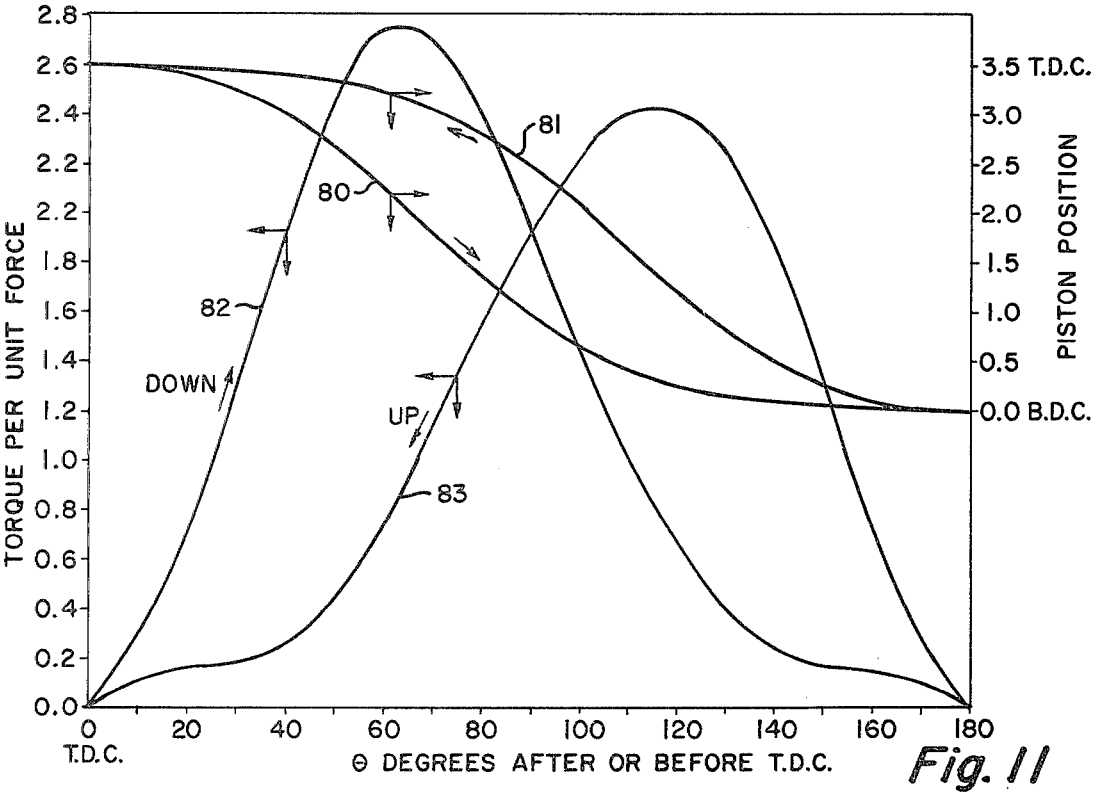

FIGS. 10 and 11 are additional graphs similar to FIGS. 6 and 7 but relating to the embodiment of FIGS. 8 and 9.

Figure 2:
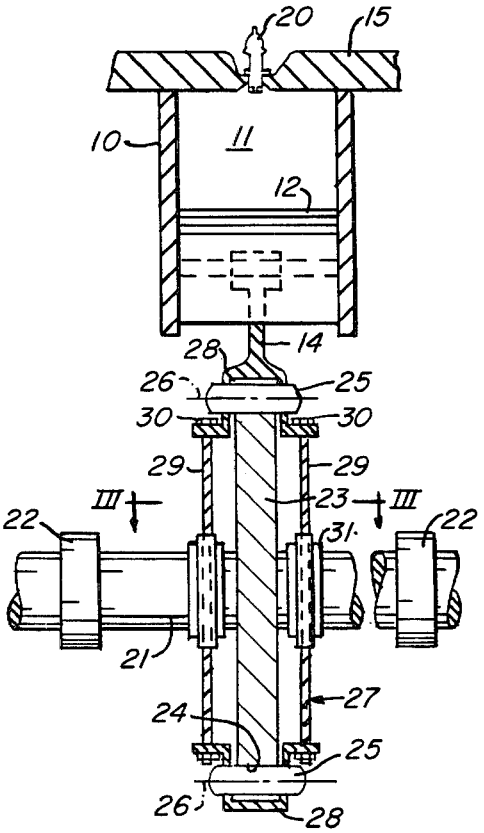
FIG. 2 is a sectional view taken along line II—II of FIG. 1.
Figure 1:
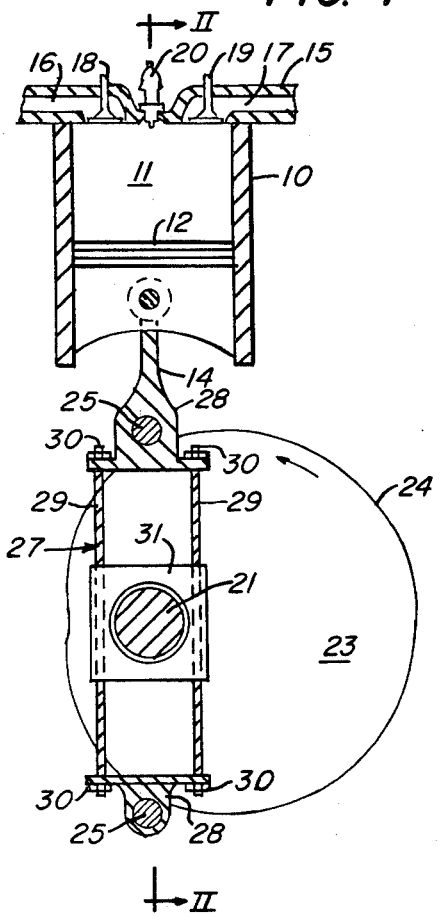
FIG. 1 is a partial elevational view, in section, through an internal combustion engine incorporating the crankshaft apparatus of the present invention.
Figure 3:
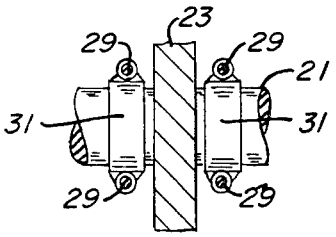
FIG. 3 is a sectional view taken along line III—III of FIG. 2.

While the crankshaft apparatus of the present invention is useful for a piston-type compressor designed for a fluid medium and gasoline, gas or diesel engines designed for two- and four-cycle operation, a four-cycle gasoline engine has been selected for the detailed disclosure by FIGS. 1–3 of the present invention. A portion of a casting forming an engine block 10 is identified by reference numeral 10. One or more spaced-apart cylinders, only one of which is shown and identified by reference numeral 11, are formed in the engine block. Each cylinder receives a piston 12 coupled by a wrist pin 13 to a connecting rod 14. The piston 12 is reciprocated in the usual fashion toward and away from a head 15 which is also a casting and bolted in the usual way to the engine block 10. The head 15 has an intake passageway 16 and an exhaust passageway 17 for the delivery and exhaust of combustion media to the combustion chambr in the cylinder under control through the operation of an intake valve 18 and an exhaust valve 19. Reference numeral 20 identifies a spark plug to ignite the combustion medium in the combustion chamber.

According to the present invention, a crankshaft apparatus is used to convert reciprocating motion of the piston 12 into rotary output motion of a drive shaft. The apparatus includes a drive shaft 21 supported at spaced-apart locations by bearing assemblies 22, per se well known in the art, for rotation of shaft 21 about a longitudinal axis perpendicular to the direction of reciprocating motion by piston 12. A cam plate 23 is mounted on shaft 21 for the delivery of torque thereto. The cam plate defines a cam surface 24 more specifically defined hereinafter. The rotational axis of cam plate 23 coincides with the rotational axis of the shaft 21. A counterweight, not shown, is employed to provide dynamic balancing for rotation of the cam and shaft 21. Two equal diameter follower rollers 25 engage the cam surface 24 at approximately diametrically-opposite cam contact points. Each follower roller 25 is rotatable about its longitudinal axis on journal portions at the opposite ends thereof. The rotational axis of rollers 25 is identified in FIG. 2 by reference numeral 26. Each axis 26 is generally parallel with the rotational axis of shaft 21. The rollers 24 are rotatably supported so that the distance between their rotational axes always remains constant. A carrier assembly 27 is employed for this purpose and includes bearing support members 28 each having a hollowed U-shaped section wherein the contact face of the follower rollers engages the cam surface. Leg sections of the bearing support members receive journal portions of the rollers and further include outwardly-extending web sections that support rod members 29. The rod members are rigidly secured to the web sections of the bearing support members by passing threaded end portions of the rods into tapped holes in the web sections and using lock nuts 30 to insure that the distance between the bearing support members remains constant. The rod members 29 extend through openings at opposite sides of a guide plate 31. Plate 31 has a hollow central portion by which the plate is journaled on shaft 21. A suitable bearing surface is provided between plate 31 and shaft 21. One of the bearing support members 28 is rigidly connected to connecting rod 14 by, for example, being machined from a single forging or casting. A box-type crosshead assembly, if desired, can be used to support each roller 25 to reduce side thrust on the piston and guide plate 31 without departing from the spirit of the present invention.

The present invention provides that the cam surface 24 is geneally sinusoidal and may include impressed harmonics forming variations thereof. The generally-sinusoidal reciprocating motion of the follower roller 25 is defined by the polar equation:

$$R = r + \tfrac{1}{2}S \sin \theta \qquad (1)$$

where:

R is the radial distance between the rotational axis of shaft 21 and the rotational axis 26 of a follower member at angle $\theta$, r is the average displacement radius of the axis of a follower roller 25, S is the stroke or total radial variation of the cam surface from the rotational axis of the shaft member, and $\theta$ is the angular displacement of a reference mark on the cam to the center line of reciprocating motion of the follower roller 25.

The cam surface of such a plate may be conveniently produced by a milling cutter in the arrangement of apparatus shown in FIG. 4. This apparatus includes a rotary cutter head 40, the diameter of which is selected to correspond to the desired diameter of the follower roller 25. However, numerically-controlled cutting machines of the present-day state of the art designs may be programmed to execute the necessary intricate movements to eliminate the requirement for a cutter head with the same diameter as the follower roller.

In FIG. 4, the rotary cutter head 40 is reciprocated in a sinusoidal fashion by an extension arm 41 and a pin follower 42. A pin 43 engaged within the pin follower 42 is mounted on a gear 44 at a distance of ½S from the center of rotation of gear 44. Shaft 45 rotates gear 44 while carried by suitable bearing supports. The sleeve 46 maintains extension arm 41 and cutter head 40 parallel with the horizontal axis. Cam plate 23 is rotated at the same speed as gear 44 rotates. It will be noted that the rotational center of the cutter head with respect to the center of rotation of cam 23 describes an exact sinusoidal reciprocating motion and is described by Equation (1). However, the cam plate 23 is no longer defined by this equation because the cutting angle 47 changes from 0° when pin 43 is on the X-axis. Harmonics can be impressed on the cam surface by dividing extension arm 41 into segments and interposing between the segments, a gear-driven follower pin to change the effective length of the extension arm in a synchronous relation with the rotation of gear 44.

The cam surface which is generated to produce the reciprocating motion of the followers according to Equation (1) may be more specifically defined in regard to the torque development properties by referring to FIG. 5. Based on the polar equation defining a circle at any given position in a polar coordinate system, the polar equation defining the surface of a follower roller 25 at any given position (R, $\theta$), about the surface 24 of cam 23 is:

$$\rho^2 - 2R\rho\cos(K-\theta) + R^2 - p^2 = 0 \qquad (2)$$

where:

$\rho$ is the distance from the origin of the polar coordinate system to any point on the surface of follower roller 25, K is an angle formed by radii extending to the axis 26 from the point on the follower roller established by $\rho$ and the horizontal plane passing to axis 26 parallel to the horizontal reference axis of the polar coordinate system, and p is the radius of the follower roller 25.

The general polar equation for xis 26 is:

$$R = f(\theta) \qquad (3)$$

However, the specific equation defining the movement of roller 25 with respect to its axis 26 about the surface of a cam without harmonics developed therein is defined by Equation (1) where the only variable is $\theta$. It follows, therefore, from Equation (3) that:

$$dR/d\theta = f'(\theta) \qquad (4)$$

Now, Equation (2) defines a family of curves with a variable $\theta$. The envelope of this family of curves defines cam surface 24. To define the envelope and thus the actual cam surface, we first differentiate Equation (2) with respect to $\theta$ and simultaneously solve Equation (2) and the differential thereof. This yields, after rearranging and simplifying terms:

$$0 = \rho^4 - 2\rho^2(R^2 + p^2) + (R^2 + p^2)^2 - \frac{4R^2p^2}{1 + \left(\frac{dR}{Rd\theta}\right)^2} \qquad (5)$$

Through the use of the quadratic formula, Equation (5) becomes:

$$\rho^2 = R^2 + p^2 \pm \frac{2Rp}{\left[1 + \left(\frac{dR}{Rd\theta}\right)^2\right]^{\frac{1}{2}}} \qquad (6)$$

This equation defines the value $\rho$ for both the inner envelope and the outer envelope of the follower movement. However, since the curve defining the cam surface is the smaller envelope of movement by follower 25, the negative of the last term in Equation (6) is used, thus giving the equation of cam surface 24, namely:

$$\rho_c^2 = R^2 + p^2 - \frac{2Rp}{\left[1 + \left(\frac{dR}{Rd\theta}\right)^2\right]^{\frac{1}{2}}} \qquad (7)$$

In FIG. 5, R′ equals $\rho_c$ which is the radical cam distance at $\theta+\beta$, where $\beta$ is the angle between R′ and R. For a non-harmonic cam:

$$dR/d\theta = \tfrac{1}{2}S\cos\theta.$$

The angle $\beta$ is equal to:

$$= \arctan\frac{p\sin\alpha}{R - p\cos\alpha} \qquad (8)$$

$\alpha$ is equal to the arctan dR/Rd$\theta$, and $\alpha$ defines the angle between R and a line perpendicular to the cam surface extending through axis 26.

FIG. 6 includes graph line 48 representing the crank angle after top dead center in relation to torque per unit of force imposed on a piston in an internal combustion engine of the standard lobe-type crank. The connecting rod length to crank length is the ratio of 4.0 and the stroke is 3.5. This graph is derived from data from *Mechanical Engineers Handbook,* Lionel S. Marks, Fifth Edition, page 943. The crankshaft apparatus employing the cam surface according to Equation (1) of the present invention is correspondingly illustrated by graph line 49 wherein the average radius, r, of the crank is equal to 3.25 inches and the stroke of the engine is 3.50 inches. The follower radius is 0.375 inch. Graph line 49, as compared with graph line 48, shows that the development of torque does not increase during the power stroke as sharply and to the same magnitude with the rotation of the crank from top dead center to 90° therefrom. The delayed peak development of torque per unit of force by a cam design represented by graph line 49 is not, per se, particularly desirable but it does offer advantages for combustion and emission control. A very favorable conversion from torque to force on the piston occurs throughout the rotation of the crank between 270° and top dead center for the exhaust and/or compression stroke of an engine. Moreover, a greater power efficiency occurs in a compressor having a cam apparatus according to a graph line 49 as compared with graph line 48 for a lobe-type crank. Torque per unit of force developed on the drive output shaft from the internal combustion engine using the crankshaft assembly having a basic cam profile according to the present invention is graphically represented by graph line 49 and comparable with graph line 48 for a standard crankshaft apparatus. The desirable development of torque per unit of force is also readily apparent from the following Table I showing at various crankshaft positions after top dead center, the torque per unit of force, T/F, calculated on the basis of different follower radii, cam plate average radius r, but with a constant stroke of 3.5 inches ($\frac{1}{2}S=1.75$):

TABLE I

| Follower Radius = p | 0.375 | | 0.75 | | 1.00 | |
|---|---|---|---|---|---|---|
| Avg. Radius r | 3.25 | | 4.00 | | 4.25 | |
| $\frac{1}{2}S$ | 1.75 | | 1.75 | | 1.75 | |
| Stroke | 3.5 | | 3.5 | | 3.5 | |
| First Harmonic | None | | None | | None | |
| Second Harmonic | None | | None | | None | |
| Degree After T.D.C. | R | T/F | R | T/F | R | T/F |
| 0 | 5.0 | — | 5.75 | — | 6.00 | — |
| 10 | 4.97 | 0.30 | 5.72 | 0.30 | 5.97 | 0.30 |
| 20 | 4.89 | 0.60 | 5.64 | 0.60 | 5.89 | 0.60 |
| 30 | 4.77 | 0.88 | 5.52 | 0.88 | 5.77 | 0.88 |
| 40 | 4.59 | 1.12 | 5.34 | 1.12 | 5.59 | 1.12 |
| 50 | 4.37 | 1.34 | 5.12 | 1.34 | 5.37 | 1.34 |
| 60 | 4.13 | 1.52 | 4.88 | 1.52 | 5.13 | 1.52 |
| 70 | 3.85 | 1.64 | 4.60 | 1.64 | 4.85 | 1.64 |
| 80 | 3.55 | 1.72 | 4.30 | 1.72 | 4.55 | 1.72 |
| 90 | 3.25 | 1.75 | 4.00 | 1.75 | 4.25 | 1.75 |
| 100 | 2.95 | 1.72 | 3.70 | 1.72 | 3.95 | 1.72 |
| 110 | 2.65 | 1.64 | 3.40 | 1.64 | 3.65 | 1.64 |
| 120 | 2.38 | 1.52 | 3.13 | 1.52 | 3.38 | 1.52 |
| 130 | 2.13 | 1.34 | 2.88 | 1.34 | 3.13 | 1.34 |
| 140 | 1.91 | 1.12 | 2.66 | 1.12 | 2.91 | 1.12 |
| 150 | 1.73 | 0.88 | 2.48 | 0.88 | 2.73 | 0.88 |
| 160 | 1.61 | 0.60 | 2.36 | 0.60 | 2.61 | 0.60 |
| 170 | 1.53 | 0.30 | 2.28 | 0.30 | 2.53 | 0.30 |
| 180 | 1.50 | — | 2.25 | — | 2.50 | — |

The torque per unit of force is developed in a symmetrical manner between the downstroke and upstroke. Moreover, the torque per unit of force on the piston as well as the piston positions relative to the cam are exactly sinusoidal. At all times, it has been discovered that the torque per unit of force on the piston is equal to $dR/d\theta$ for the embodiment of the crankshaft apparatus shown in FIGS. 1–3. The max torque for a non-harmonic cam is $\frac{1}{2}S$. For all cams with or without harmonics, the torque produced does not vary with changes in r or p.

Returning now to FIG. 6, graph line 50 represents the development of torque per unit of force with crank angle displacements after top dead center of a cam with harmonics impressed on the cam profile surface thereof. The top dead-center position for graph line 50 occurs at approximately $\theta=113°$. The harmonic is an extension of the basic cam profile given by Equation (1). The polar equation for the first harmonic of this modified cam profile is given by the following equation:

$$R=r+\tfrac{1}{2}S\sin\theta+\tfrac{1}{2}S'\sin 3(\theta+a) \quad (9)$$

where:

S′ equals the total amplitude of the impressed first harmonic, and a is equal to a fixed phase angle with any value of ± from 0° to 180°.

A cam with the second harmonic is defined by the polar equation:

$$R=r+\tfrac{1}{2}S\sin\theta+\tfrac{1}{2}S'\sin 3(\theta+a)+\tfrac{1}{2}S''\sin 5(\theta+b) \quad (10)$$

where:

S″ is equal to the total amplitude of the impressed second harmonic, and b is equal to a fixed phase angle with any value of ± from 0° to 180°.

In a similar way, the third harmonic is given by the polar equation:

$$R=r+\tfrac{1}{2}S\sin\theta+\tfrac{1}{2}S'\sin 3(\theta+a)+\tfrac{1}{2}S''\sin 5(\theta+b)+\tfrac{1}{2}S'''\sin 9(\theta+c) \quad (11)$$

where:

S‴ is the total amplitude of the impressed third harmonic, and c is equal to a fixed phase angle with any value of ± from 0° to 180°.

Graph line 50 is based on the development of a cam having a first harmonic where the value of S′ is equal to 0.25 at +15° out of phase. The base radius is equal to 3.25 inches and the stroke of the internal combustion engine is equal to 3.5 inches with a follower radius of 0.375 inch. The cam apparatus using the impressed harmonic on the cam surface has a very high torque amplification factor per unit of force whereby within the first 60° rotation after top dead center, the development of torque per unit of force reaches a maximum of 2.4. This greatly exceeds the 1.8 factor developed at a later time after top dead center by the standard crank design shown graphically by graph line 48.

The graphs in FIG. 7 illustrate impressed harmonics on the basic cam design of the present invention with given dimensional characteristics. Graph line 51 shows displacement of a follower roller with respect to the rotational axis of the cam shaft member through a revolution thereof defined by the polar equation:

$$Y=1.75\sin\theta+0.25\sin 3(\theta-15) \quad (12)$$

The selected angle is −15° for the impressed harmonic at a $\frac{1}{2}S'$ value of 0.25. The values of r and p in Equation (12) are zero so that only relative motion of the follower is shown. Graph line 52 shows a second harmonic for displacement of a follower from the rotational axis by a distance of 3.50 inches using the second harmonic defined by the polar equation:

$$Y=1.75\sin\theta+0.25\sin 3(\theta-15)+0.125\sin 5(\theta+10) \quad (13)$$

Graph line 52 is an extension of graph line 51 by the additional impressed harmonic where the S″ value is equal to 0.125 and selected angle +10° for the second harmonic. A further second harmonic displacement diagram is illustrated by graph line 53 where the displacement of a follower from the rotational axis is 3.50 inches. The polar expression for the curve 53 is:

$$Y = 1.75 \sin \theta + 0.25 \sin 3(\theta - 30°) + 0.06 \sin 5\theta \quad (14)$$

The impressed harmonics occur at −30° and 0°, respectively, with the values of $\frac{1}{2}S'$ and $\frac{1}{2}S''$ equalling to 0.25 and 0.06, respectively.

FIGS. 8 and 9 illustrate a further embodiment of the crankshaft apparatus according to the present invention which includes control arms to maintain the position of the follower rollers. While two control arms are illustrated, it is to be understood that,when desired, one control arm may be employed for positioning a follower roller in which event a guide means, such as guide plate 31 described hereinbefore, is used to maintain the follower rollers in their proper positions. In FIGS. 8 and 9, the casting of engine block 10 forms a cylinder 11 wherein a piston 12 reciprocates while coupled by a wrist pin 13 to connecting rod 60. The combustion chamber is closed by a head, not shown, having the usual intake and exhaust passageways as previously desribed. The constant diameter cam 23 is joined with shaft 21 and supported by bearings 22 as previously described. The cam surface 24 is contacted at diametrically-opposite locations by follower rollers 61 and 62 rotatable about longitudinal axes on arbor portions 63 and 64, respectively. The rotational axes of the rollers extend generally parallel with the rotational axis of the shaft 21 while the distance between the rotational axes of the rollers always remains constant. Each follower roller is supported by a carrier assembly 65 that includes bearing support members 66 to rotatably support the arbor position. The connecting rod 60 has a clevis formed in its end portion so that the body section of follower roller 61 can freely rotate within the opening of the clevis when joined to the arbor 63 of the follower roller. Rod members 67 are rigidly secured to web sections of the bearing support members. Preferably, the rod members have threaded end portions that are received in threaded openings of the bearing support members and secured by lock nuts 68 to insure that the distance between the bearing support members remains constant. An upper control arm 71 and a lower control arm 72 each has a clevis-shaped forked end with aligned bored openings to receive the arbor shaft of the respective follower roller. The free end of each control arm is anchored for pivotal movement by a shaft 73 that is, in turn, supported by the casting of the engine. As shown in FIG. 8, the pivot axis of each shaft 73 is spaced by a distance E from a horizontal plane passing through the rotational axis of shaft 21. The distance between the pivot axis for each control arm and a vertical plane passing through the rotational axis of shaft 21 is identified by M. The effective length of each control arm is identified by G and the effective length of the connecting rod is identified by N.

The following Table II contains a numerical tabulation of data determined for each 10° angular displacement of the cam from a fixed reference point. The data in Table II is for a crankshaft apparatus having a construction of parts similar to that illustrated in FIGS. 8 and 9, but excluding the control arm 72 whereby the upper follower roller 61 is controlled only by control arm 71 and a guide plate 31 (FIGS. 1 and 2) is used on rods 67 to maintain proper positioning of the follower roller 62.

TABLE II

| | |
|---|---|
| Follower Radius = p | = 1.0 |
| Avg. Radius r | = 4.0 |
| $\frac{1}{2}S$ | = 1.75 |
| Stroke | = 3.5 |
| M | = 4.0 |
| E | = 4.0 |
| G | = 4.366 |
| N | = 4.0 |
| T.D.C. @ $\theta$ | = 90° |

| | Degree | R | dR/d$\theta$ | s° | T/F |
|---|---|---|---|---|---|
| T.D.C. | 0 | 5.75 | 0.00 | 0.00 | 0.00 |
| | 10 | 5.72 | −0.30 | 0.12 | −0.31 |
| | 20 | 5.64 | −0.60 | 0.45 | −0.63 |
| | 30 | 5.51 | −0.875 | 0.99 | −0.95 |
| | 40 | 5.34 | −1.12 | 1.67 | −1.24 |
| | 50 | 5.12 | −1.34 | 2.46 | −1.50 |
| | 60 | 4.87 | −1.52 | 3.28 | −1.70 |
| | 70 | 4.60 | −1.64 | 4.07 | −1.82 |
| | 80 | 4.30 | −1.72 | 4.75 | −1.86 |
| | 90 | 4.00 | −1.75 | 5.25 | −1.83 |
| | 100 | 3.70 | −1.72 | 5.50 | −1.73 |
| | 110 | 3.40 | −1.64 | 5.44 | −1.58 |
| | 120 | 3.12 | −1.52 | 5.05 | −1.39 |
| | 130 | 2.85 | −1.34 | 4.32 | −1.19 |
| | 140 | 2.66 | −1.12 | 3.31 | −0.98 |
| | 150 | 2.48 | −0.875 | 2.17 | −0.77 |
| | 160 | 2.35 | −0.60 | 1.08 | −0.54 |
| | 170 | 2.27 | −0.30 | 0.29 | −0.29 |
| B.D.C. | 180 | 2.25 | 0.00 | 0.00 | 0.00 |
| | 190 | 2.27 | 0.30 | 0.29 | 0.32 |
| | 200 | 2.35 | 0.60 | 1.08 | 0.66 |
| | 210 | 2.48 | 0.875 | 2.17 | 0.97 |
| | 220 | 2.66 | 1.12 | 3.31 | 1.23 |
| | 230 | 2.88 | 1.34 | 4.32 | 1.42 |
| | 240 | 3.125 | 1.52 | 5.65 | 1.56 |
| | 250 | 3.40 | 1.64 | 5.44 | 1.64 |
| | 260 | 3.70 | 1.72 | 5.50 | 1.69 |
| | 270 | 4.00 | 1.75 | 5.25 | 1.69 |
| | 280 | 4.30 | 1.72 | 4.75 | 1.65 |
| | 290 | 4.60 | 1.64 | 4.07 | 1.57 |
| | 300 | 4.875 | 1.52 | 3.28 | 1.44 |
| | 310 | 5.12 | 1.34 | 2.46 | 1.27 |
| | 320 | 5.34 | 1.12 | 1.67 | 1.07 |
| | 330 | 5.52 | 0.875 | 0.99 | 0.84 |
| | 340 | 5.64 | 0.60 | 0.45 | 0.58 |
| | 350 | 5.72 | 0.30 | 0.12 | 0.30 |
| T.D.C. | 360 | 5.75 | 0.00 | 0.00 | 0.00 |

The data tabulated in Table II applies to a nonharmonic cam with one control arm and produces a torque curve as shown in FIG. 10. The cam does not include harmonics and the values of the distances M, E, G and N were chosen to make the center of rotation of the follower rollers coincide with the center line through the main shaft and the wrist pin at top dead center and at bottom dead center. This coincidence of the center line is not a requirement of this embodiment of the present invention, but chosen to facilitate calculations. The graph of FIG. 10 illustrates the non-harmonic cam with the control arms 71 and 72 to produce a downstroke and upstroke motion of the piston. The motion of the piston versus the crank rotation reveals that the torque curves are not identical. The graph line for the downstroke curve develops a torque per unit of force that rises quicker and to a greater magnitude than the return stroke. In other words, reversing the drection of the crank rotation affects the torque output since the cam apparatus when rotated in the reverse direction would reverse the up and down notations applied to the graphs in FIG. 10. The graph lines of FIG. 11 illustrate the development of torque per unit of force by a crankshaft apparatus having the cam with a harmonic defined by Equation (9) impressed on the cam surface. The development of FIG. 11 is based on dimensional relationships for parts shown in FIG. 8 of which the average radius r=4.0; $\frac{1}{2}S=1.915$; $\frac{1}{2}S'=0.2$; a=5°; M=4; E=4; G=4.366; N=4 and T.D.C. $\theta=107°$. The follower roller 61 has a radius p=1.0 and is coupled to the control arm 71. The graph lines of FIG. 11 illustrate the fact that with the control arm and the harmonic impressed on the cam surface there is produced an upstroke that is not a mirror image of the downstroke even though position curves 80 and 81 for the piston are upside-down mirror images. In view of the foregoing, it will be understood by those skilled in the art that the crankshaft apparatus of the present invention may incorporate additional delays at top dead center and bottom dead center by providing that rotation of the cam supplies additional dwell times for such positioning of the follower rollers. While such a curve is not shown, the effect is that of compressing the cam curves shown in FIGS. 10 and 11. The curves 82 and 83 of FIG. 11 show the development of a power stroke, i.e., downstroke of the pistion, with a peak torque per unit of force on the piston of 2.74 at the crank rotation of 56° past top dead center. This is 0.93 unit more than the 1.81 torque per unit of force that occurs for a standard lobe-type crank with a 4:1 ratio of connecting rod length to crank throw. Thus, from the graph of FIG. 11, it can be seen that the peak torque per unit of force is 1.51 times that of a standard crank. Moreover, this torque is developed when the piston has moved only 36% of its total stroke versus 47% of the total stroke by the piston in an engine having a standard lobe-type crank. This provides a far more favorable relationship for an internal combustion engine whereby higher pressures are present in the combustion chamber at smaller volumes and thereby produce even greater power outputs via drive shaft 21.

Polar Equation (1) defines a single lobe-cam profile and excludes all harmonics that can be impressed on the cam profile. There are five allowable harmonics that can be impressed on this cam profile of which Equations (9), (10) and (11) define the first three such harmonics. The general and complete polar equation for the cam surface used in the cam shaft apparatus of the present invention is given by the following equation:

$$R=r+\tfrac{1}{2}S\sin(\theta)+\tfrac{1}{2}S'\sin 3(\theta+a)+\tfrac{1}{2}S''\sin 5(\theta+b)+\tfrac{1}{2}S'''\sin 9(\theta+c)+\tfrac{1}{2}S''''\sin 15(\theta+d)+\tfrac{1}{2}S'''''\sin 45(\theta+e \quad (15)$$

where:

R is the radial distance between the rotational axes of the shaft member and a follower member at angle $\theta$, r is the average displacement radius of the axis of the follower roller, S, S′, S″, S‴, S⁗ and S′′′′′ are radial variations in the cam surface with S not equal to zero and having the greatest absolute value, a, b, c, d and e are fixed phase angles with any value of ± from 0° to 180°, and $\theta$ is the angular displacement of a reference mark on the cam to the center line of reciprocating motion of the follower rollers.

Any one, several or all of the S′ . . . S′′′′′ terms can have allowable values less than the absolute value of S. The number of harmonics impressed on the cam surface is defined by the number of S-prime terms. The allowable harmonics are all evenly divisible into 360° and constants 3, 5, 9, 15 and 45 must be an odd number. Since a single lobe cam configuration is dominate and basic to the present invention, the absolute value of S must always exceed any and all S-prime factors.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A crankshaft apparatus in an internal combustion engine or a compressor havng a piston arranged to reciprocate within a cylinder to act on a fluid medium within a chamber at one end of the piston, said crankshaft apparatus including the combination of:

a shaft member carried by bearing supports for rotation about an axis perpendicular to reciprocation of said piston the cylinder at the end thereof opposite said chamber, a cam plate defining a cam surface secured to said shaft member for rotation thereof, two equal diameter follower rollers engaging said cam surface at diametrically-opposite points to rotate said cam, and means supporting said follower rollers to maintain the axes of the follower rollers generally parallel with the rotational axis of said shaft member while interconnecting said rollers with said piston, each rotational axis of the follower rollers being spaced by said cam surface from the rotational axis of said shaft member according to the polar equation:

$$R=r+\tfrac{1}{2}S\sin(\theta)+\tfrac{1}{2}S'\sin 3(\theta+a)+\tfrac{1}{2}S''\sin 5(\theta+b)+\tfrac{1}{2}S'''\sin 9(\theta+c)+\tfrac{1}{2}S''''\sin 15(\theta+d)+\tfrac{1}{2}S'''''\sin 45(\theta+e)$$

where:

R is the radial distance between the rotational axis of the shaft member and a follower member at angle $\theta$, r is the average displacement radius of the axis of the follower roller, S, S′, S″, S‴, S⁗ and S′′′′′ are radial variations in the same surface with S not equal to zero and having the greatest absolute value, a, b, c, d and e are fixed phase angles with any value of ± from 0° to 180°, and $\theta$ is the angular displacement of a reference mark on the cam to the center line of reciprocating motion of the follower rollers.

2. The crankshaft apparatus according to claim 1 wherein said means includes a connector rod joined by a pin member to said piston.

3. The crankshaft apparatus according to claim 1 wherein said means includes a carrier housing extending along each side of said cam plate, each carrier housing having a hollow central portion for positional support by said shaft member.

4. The crankshaft apparatus according to claim 3 wherein each carrier housing including a slide plate defining said hollow central portion, and spacer rods normally supporting said slide plate to maintain said follower rollers at a uniform spacing and in alignment with the center of rotation of the shaft member and the center of the combustion chamber.

5. The crankshaft apparatus according to claim 1 wherein the radius of the milling cutter passed about said cam plate for defining said cam surface is equal to the radii of said follower rollers.

6. The crankshaft apparaus according to claim 1 wherein said means supporting said follower rollers includes a control arm supported at one end for pivotal movement and coupled to the other end to one of said two equal diameter follower rollers.

7. The crankshaft apparatus according to claim 1 wherein said means supporting said follower rollers includes upper and lower control arms each supported at one of their ends for pivotal movement and separately coupled by their other ends to said two equal diameter follower rollers.

* * * * *